US010617934B2

(12) United States Patent
Wu

(10) Patent No.: US 10,617,934 B2
(45) Date of Patent: Apr. 14, 2020

(54) BOTTOM STRUCTURE OF ROLLER SKATE

(71) Applicant: Anita Wu, Guangdong (CN)

(72) Inventor: Anita Wu, Guangdong (CN)

(73) Assignee: Dongguan Hongmei Sports Equipment Co., Ltd., Dongguan (CN)

( * ) Notice: Subject to any disclaimer, the term of this patent is extended or adjusted under 35 U.S.C. 154(b) by 0 days.

(21) Appl. No.: 16/384,938

(22) Filed: Apr. 16, 2019

(65) Prior Publication Data

US 2019/0240562 A1 Aug. 8, 2019

(51) Int. Cl.
*A63C 17/02* (2006.01)
*A63C 17/14* (2006.01)

(52) U.S. Cl.
CPC ..... *A63C 17/02* (2013.01); *A63C 17/14* (2013.01)

(58) Field of Classification Search
CPC ... A63C 17/02; A63C 17/223; A63C 17/0046; A63C 17/14; A63C 17/0093; A63C 17/1436; A63C 2203/20; A63C 17/40
See application file for complete search history.

(56) References Cited

U.S. PATENT DOCUMENTS 324,376 A * 8/1885 Hart ..... A63C 17/02 280/11.28
2,726,873 A * 12/1955 Woolley ..... A63C 17/22 280/11.28
3,087,739 A * 4/1963 Ware ..... A63C 17/02 280/11.28
3,331,612 A * 7/1967 Tietge ..... A63C 17/015 280/11.28
3,437,344 A * 4/1969 Shevelson ..... A63C 17/02 280/11.209
3,580,595 A * 5/1971 Ware ..... A63C 17/14 280/11.209
3,901,521 A * 8/1975 Famolare, Jr. ..... A63C 17/14 280/11.209
4,138,127 A * 2/1979 Kimmell ..... A63C 17/064 280/11.227
4,262,918 A * 4/1981 Sandino ..... A63C 17/0086 280/11.26
4,313,610 A * 2/1982 Volk ..... A63C 17/02 280/11.28
4,374,548 A * 2/1983 Ueno ..... B60G 11/22 180/266
4,382,605 A * 5/1983 Hegna ..... A63C 17/0046 280/11.225
4,403,784 A * 9/1983 Gray ..... A63C 17/02 280/11.28

(Continued)

FOREIGN PATENT DOCUMENTS

GB 2526076 A * 11/2015 ..... A63C 17/012

*Primary Examiner* — Jacob B Meyer

(57) ABSTRACT

A bottom structure of a roller skate includes a sole; a frame secured to the sole and including front and rear supports and two hubs disposed on the front and rear supports respectively; a pivotal member disposed in the hub; two spaced sleeves disposed in the hub wherein the sleeves are further partially disposed in the pivotal member and secured to the pivotal member; a shaft passing through the hub, the pivotal member, and a gap between the sleeves, and rigidly secured to the pivotal member; and two enlargements disposed at two ends of the shaft respectively.

6 Claims, 4 Drawing Sheets

(56) References Cited

U.S. PATENT DOCUMENTS 5,199,727 A * 4/1993 Lai ..... A63C 17/0093 280/11.19
5,551,713 A * 9/1996 Alexander ..... A63C 17/0046 280/11.19
5,575,489 A * 11/1996 Oyen ..... A63C 17/0046 280/11.225
5,718,438 A * 2/1998 Cho ..... A63C 17/0046 280/11.27
5,951,027 A * 9/1999 Oyen ..... A63C 17/0046 280/11.208
6,186,518 B1 * 2/2001 Moses ..... A63C 17/0046 280/11.223
6,416,063 B1 * 7/2002 Stillinger ..... A63C 17/0046 280/11.223
6,439,584 B1 * 8/2002 Lai ..... A63C 17/04 280/11.221
6,616,155 B2 * 9/2003 Tuan ..... A63C 17/01 280/11.28
6,663,116 B2 * 12/2003 Evans ..... A63C 17/0046 280/11.221
6,679,505 B2 * 1/2004 Yang ..... A63C 17/0046 280/11.19
6,863,283 B1 * 3/2005 Houston ..... A63C 17/0046 280/11.225
7,121,561 B2 * 10/2006 Green ..... A63C 17/0046 280/11.19
7,121,566 B2 * 10/2006 McClain ..... A63C 17/0093 280/87.042
7,243,925 B2 * 7/2007 Lukoszek ..... A63C 17/0093 280/11.28
7,316,408 B2 * 1/2008 McClain ..... A63C 17/0093 280/11.28
7,618,046 B2 * 11/2009 Green ..... A63C 17/0046 280/11.19
7,984,917 B2 * 7/2011 Lake ..... A63C 17/0046 280/11.27
8,251,377 B2 * 8/2012 Green ..... A63C 17/0086 280/11.231
8,251,384 B1 * 8/2012 Christensen ..... A63C 17/015 280/11.115
8,297,656 B2 * 10/2012 Arbogast ..... A63C 17/0006 280/11.221
8,465,027 B2 * 6/2013 Burke ..... A63C 17/02 280/11.19
8,550,473 B2 * 10/2013 Miller ..... A63C 17/02 280/11.28
8,556,275 B1 * 10/2013 Miller ..... A63C 17/02 280/11.19
8,657,302 B1 * 2/2014 Chen ..... A63C 17/02 280/11.208
8,857,824 B2 * 10/2014 Miller ..... A63C 17/02 280/11.28
8,973,923 B2 * 3/2015 Miller ..... A63C 17/02 280/11.27
9,010,777 B2 * 4/2015 Braden ..... A63C 17/012 280/11.28
9,095,765 B2 * 8/2015 Miller ..... A63C 17/02
9,149,712 B2 * 10/2015 Hering ..... A63C 17/0006
9,415,295 B2 * 8/2016 Braden ..... A63C 17/012
2002/0084602 A1 * 7/2002 Feng ..... A63C 17/02 280/11.223
2003/0038433 A1 * 2/2003 Lin ..... A63C 17/14 280/11.204
2003/0116930 A1 * 6/2003 Gorisch ..... A63C 17/04 280/11.27
2003/0146585 A1 * 8/2003 Yang ..... A63C 17/0046 280/11.208
2004/0026984 A1 * 2/2004 Hurwitz ..... A63C 17/0066 301/5.301
2004/0232633 A1 * 11/2004 Chaput ..... A63C 17/0046 280/11.28
2005/0046126 A1 * 3/2005 Green ..... A63C 17/0046 280/11.26
2005/0146100 A1 * 7/2005 Hurwitz ..... A63C 17/0066 280/11.223
2008/0246235 A1 * 10/2008 Alexander ..... A63C 17/0046 280/11.225
2009/0256324 A1 * 10/2009 Lake ..... A63C 17/0046 280/87.042
2010/0032917 A1 * 2/2010 Roy ..... A63C 17/0046 280/11.221
2010/0207310 A1 * 8/2010 Longino ..... A63C 17/0046 267/292
2010/0213678 A1 * 8/2010 Longino ..... A63C 17/0046 280/11.225
2010/0253057 A1 * 10/2010 Arbogast ..... A63C 17/0006 280/844
2010/0295260 A1 * 11/2010 Trew ..... A63C 17/0046 280/11.204
2011/0316245 A1 * 12/2011 Burke ..... A63C 17/0093 280/11.27
2012/0133104 A1 * 5/2012 Mars ..... A63C 17/0046 280/11.221
2012/0248718 A1 * 10/2012 Miller ..... A63C 17/02 280/11.27
2013/0300098 A1 * 11/2013 Karlsen ..... A63C 17/045 280/842
2014/0034796 A1 * 2/2014 Hering ..... A63C 17/0006 248/231.71
2015/0042083 A1 * 2/2015 Parent ..... A63C 17/0046 280/842
2015/0091263 A1 * 4/2015 Lewis ..... A63C 17/06 280/11.223
2019/0240562 A1 * 8/2019 Wu ..... A63C 17/1436
2019/0255423 A1 * 8/2019 Tyler ..... A63C 17/015

* cited by examiner

BOTTOM STRUCTURE OF ROLLER SKATE

BACKGROUND OF THE INVENTION

1. Field of the Invention

The invention relates to roller skates and more particularly to a bottom structure of a roller skate capable of keeping balance when encountering irregularities in rolling.

2. Description of Related Art

Roller skates are shoes that are worn to enable the wearer to roll along on wheels. "Quad" style of roller skate became more popular consisting of four wheels arranged in the same configuration as a typical car.

However, one drawback of a conventional bottom structure of a roller skate is that axles may be loosened resulting in malfunction of wheels when rolling on an uneven ground.

Thus, the need for improvement still exists.

SUMMARY OF THE INVENTION

It is therefore one object of the invention to provide a bottom structure of a roller skate comprising a sole; a frame secured to the sole and including front and rear supports and two hubs provided on the front and rear supports respectively; a pivotal member disposed in the hub; two spaced sleeves disposed in the hub wherein the sleeves are further partially disposed in the pivotal member and secured to the pivotal member; a shaft passing through the hub, the pivotal member, and a gap between the sleeves, and rigidly secured to the pivotal member; and two enlargements disposed at two ends of the shaft respectively.

The above and other objects, features and advantages of the invention will become apparent from the following detailed description taken with the accompanying drawings.

DETAILED DESCRIPTION OF THE INVENTION

Figure 1:
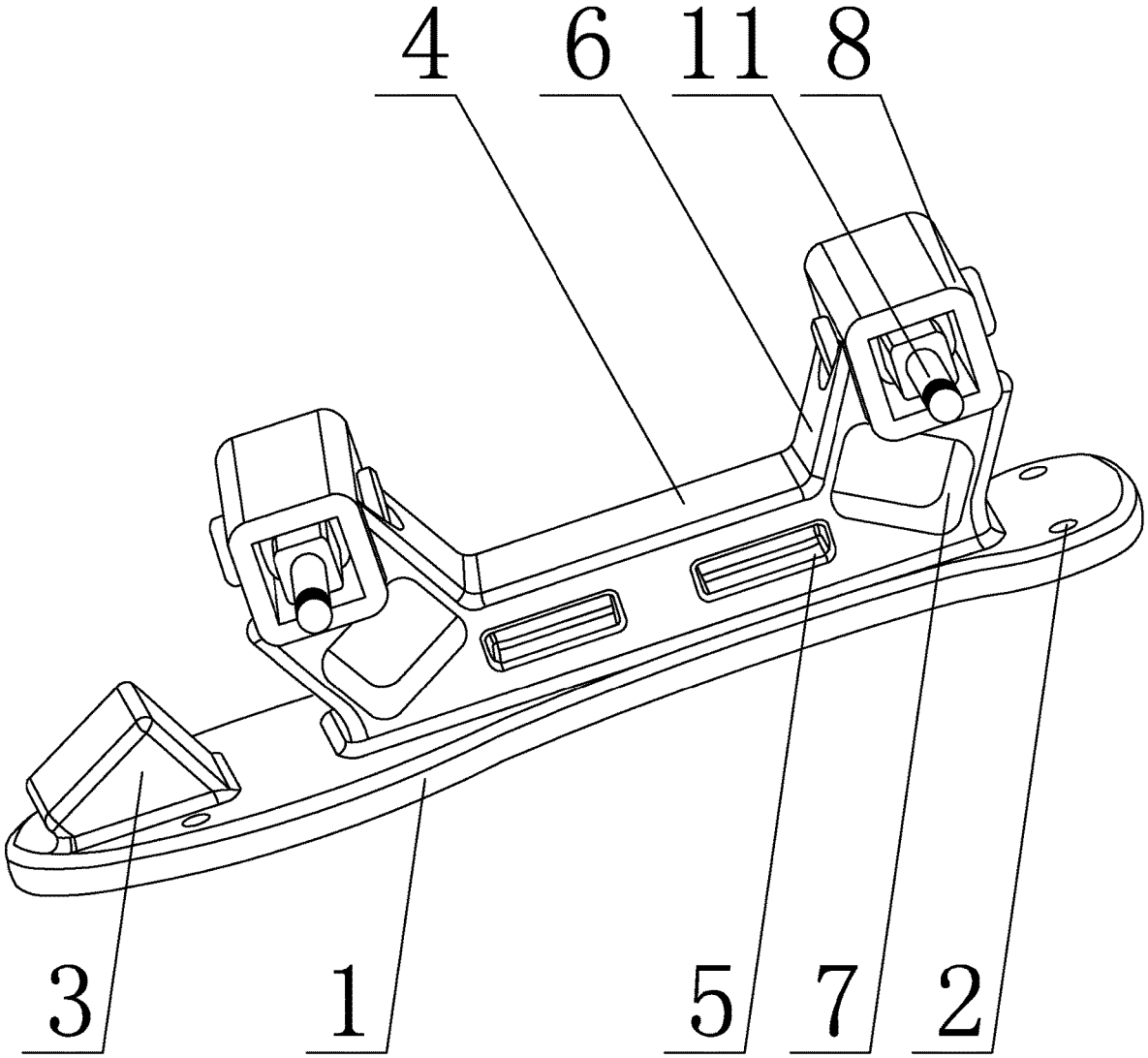
FIG. 1 is a perspective view of a bottom structure of a roller skate according to the invention.
Figure 2:
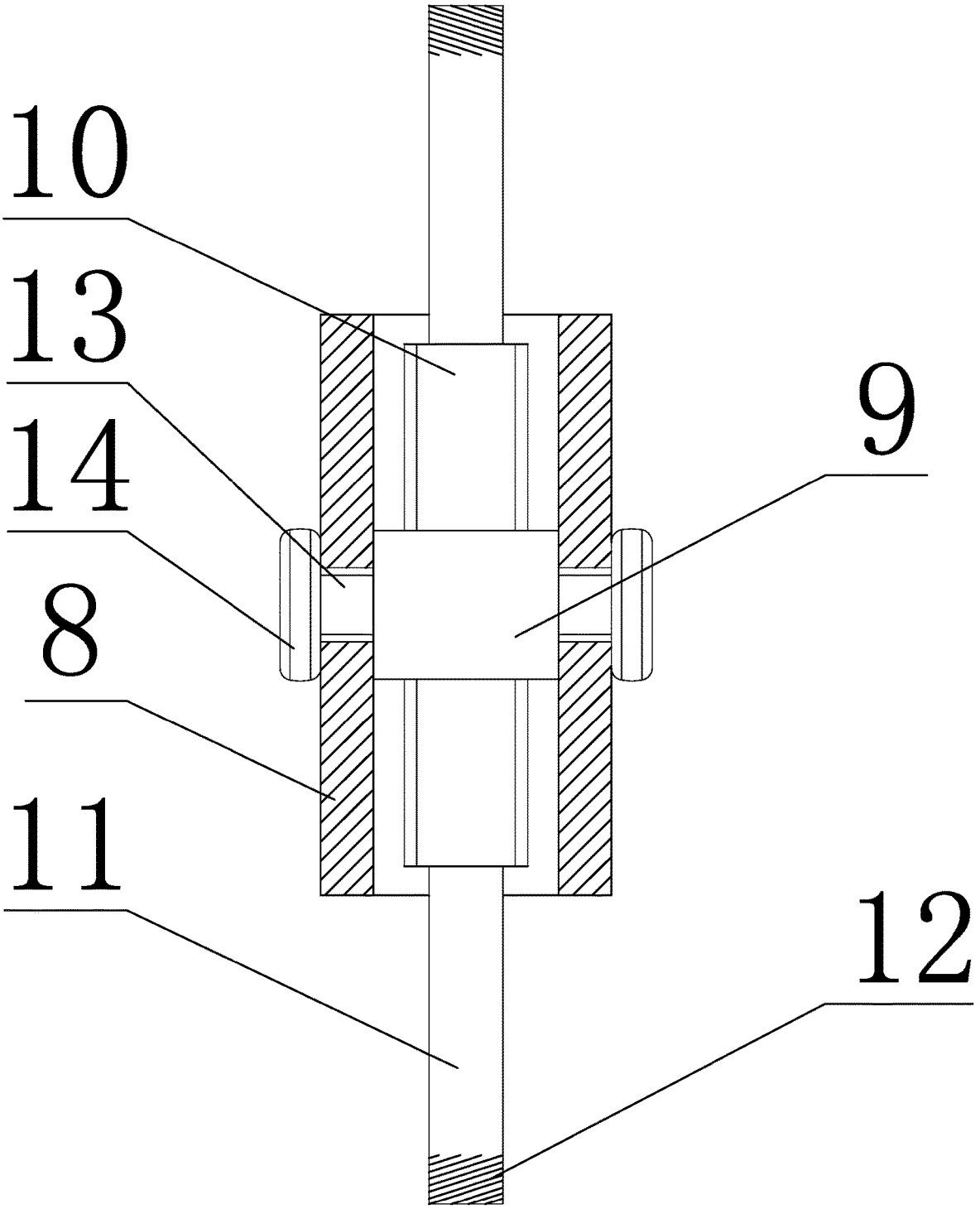
FIG. 2 is a sectional view of the hub and associated components.
Figure 3:
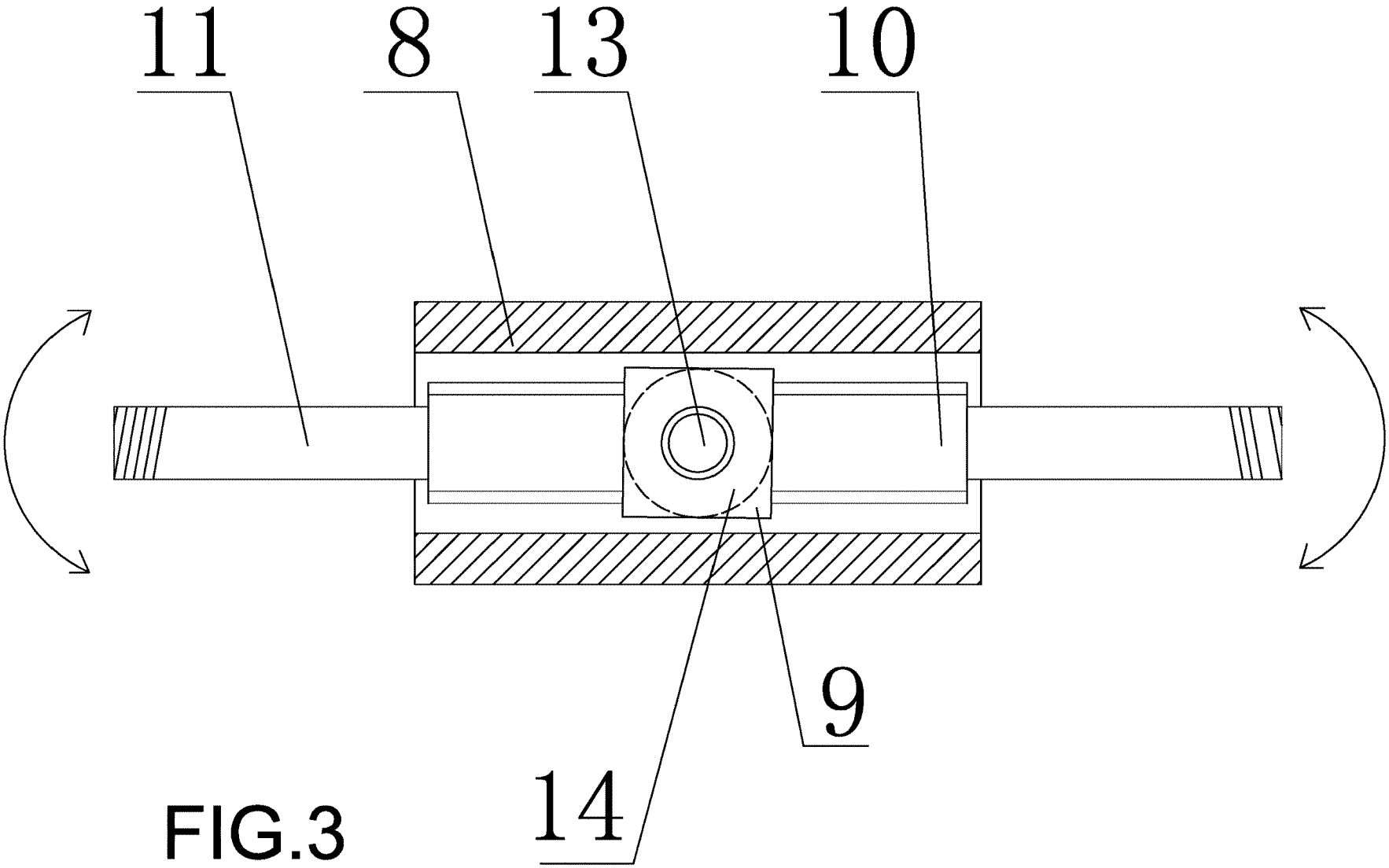
FIG. 3 is a longitudinal sectional view of the hub and associated components.
Figure 4:
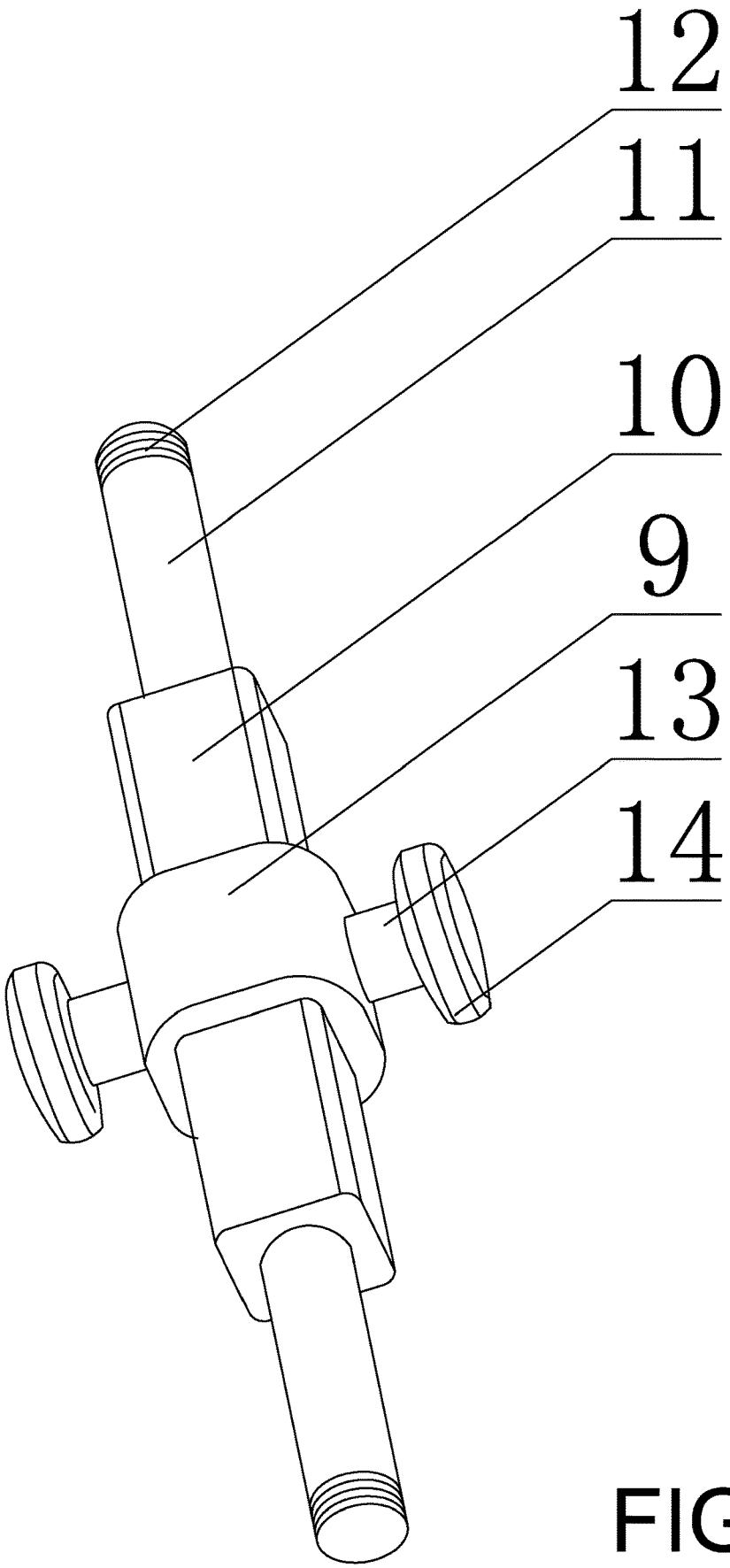
FIG. 4 is a perspective view of the components partially enclosed by the hub.

Referring to FIGS. 1 to 4, a bottom structure of a roller skate in accordance with the invention comprises a sole 1 including a plurality of apertures 2 for securing to a boot of the roller skate; a brake 3 disposed on a front portion of a bottom of the sole 1; a frame 4 rigidly secured to the sole 1 and including front and rear transverse channels 7, two intermediate transverse tunnels 5, and two supports 6 each with the transverse channel 7 passing through; and two hubs 8 provided on the supports 6 respectively.

A pivotal member 9 is provided in the hub 8. Two spaced sleeves 10 are disposed in the hub 8. The sleeves 10 are further partially disposed in the pivotal member 9 and secured to the pivotal member 9. Two aligned axles 11 each has one end secured to the sleeve 10 and the other end formed as threads 12. A shaft 13 passes through the hub 8, the pivotal member 9 and a gap between the sleeves 10. Two enlargements 14 are provided at two ends of the shaft 13 respectively. The enlargements 14 are disposed externally of the hub 8. The shaft 13 has a length about equal to that of the hub 8. The shaft 13 is rigidly secured to the pivotal member 9.

A wheel is mounted on the threads 12. The provision of the tunnels 5 can increase the structural strength of the frame 4 and the provision of the channels 7 can increase the structural strength of the support 6 respectively. The pivotal member 9 is configured to clockwise or counterclockwise pivot a limited angle in the hub 8.

An individual wearing the roller skates may roll along on wheels. One or more wheels may move upward or downward when the roller skates encounter irregularities on the ground. And in turn, the axle 11 inclines (i.e., pivots) as indicated by arrows in FIG. 3. Also, both the pivotal member 9 and the shaft 13 pivot until the pivotal member 9 contacts the hub 8 (i.e., stopped by the hub 8). As an end, the sole 1 is kept at a substantially horizontal position, thereby enabling a smooth rolling and further preventing the feet from being hurt.

While the invention has been described in terms of preferred embodiments, those skilled in the art will recognize that the invention can be practiced with modifications within the spirit and scope of the appended claims.

What is claimed is:

1. A bottom structure of a roller skate, comprising:

a sole;

a frame secured to the sole and including front and rear supports and two hubs disposed on the front and rear supports respectively;

a pivotal member disposed in the hub;

two spaced sleeves disposed in the hub wherein the sleeves are further partially disposed in the pivotal member and secured to the pivotal member;

a shaft passing through the hub, the pivotal member, and a gap between the sleeves, and rigidly secured to the pivotal member; and two enlargements disposed at two ends of the shaft respectively.

2. The bottom structure of a roller skate of claim 1, wherein the sole includes a plurality of apertures and a brake disposed on a front portion of a bottom of the sole.

3. The bottom structure of a roller skate of claim 1, wherein the frame further comprises two intermediate transverse tunnels and front and rear transverse channels passing through the front and rear supports respectively.

4. The bottom structure of a roller skate of claim 1, wherein the frame is rigidly secured to the sole, and the front and rear supports are formed with the frame.

5. The bottom structure of a roller skate of claim 1, wherein the pivotal member is configured to pivot about the hub, the shaft has one end passing through the hub, the shaft is configured to pivot about the hub, the shaft has a length about equal to that of the hub, the shaft is rigidly secured to the pivotal member, and the enlargements are disposed externally of the hub.

6. The bottom structure of a roller skate of claim 1, further comprising two aligned axles each having one end secured to the sleeve and the other end formed as threads, wherein the sleeves are completely disposed in the hub, and wherein the sleeves are rigidly secured to the pivotal member.

* * * * *